US007997258B2

(12) United States Patent
Shepley et al.

(10) Patent No.: US 7,997,258 B2
(45) Date of Patent: Aug. 16, 2011

(54) CROSSBOW STOCK HAVING LOWER FLOATING RAIL

(75) Inventors: Paul Edwin Shepley, Tucson, AZ (US); Kevin Hansen, Tucson, AZ (US); Allen C. Rasor, Jr., Marana, AZ (US); David H. Kronengold, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 12/683,816

(22) Filed: Jan. 7, 2010

(65) Prior Publication Data

US 2010/0170489 A1 Jul. 8, 2010

Related U.S. Application Data

(63) Continuation-in-part of application No. 12/350,106, filed on Jan. 7, 2009, now Pat. No. 7,810,480.

(51) Int. Cl.
*F41B 5/12* (2006.01)

(52) U.S. Cl. ..... 124/25

(58) Field of Classification Search ..... 124/25, 124/86, 88

See application file for complete search history.

(56) References Cited

U.S. PATENT DOCUMENTS

| | | | | |
|---|---|---|---|---|
| 4,258,689 | A | 3/1981 | Barnett | |
| 4,603,676 | A | 8/1986 | Luoma | |
| 4,649,892 | A | 3/1987 | Bozek | |
| 4,719,897 | A | 1/1988 | Gaudreau | |
| 4,996,968 | A | 3/1991 | Hollingsworth | |
| 5,343,650 | A | 9/1994 | Swan | |
| 5,590,484 | A | 1/1997 | Mooney et al. | |
| 5,826,363 | A | 10/1998 | Olson | |
| 6,205,990 | B1 | 3/2001 | Adkins | |
| 6,425,386 | B1 | 7/2002 | Adkins | |
| 6,490,822 | B1 | 12/2002 | Swan | |
| 6,609,321 | B2 | 8/2003 | Faifer | |
| 6,839,998 | B1 | 1/2005 | Armstrong | |
| 6,854,206 | B2 | 2/2005 | Oz | |
| 7,624,724 | B2 * | 12/2009 | Bednar et al. | 124/25 |

* cited by examiner

*Primary Examiner* — John Ricci
(74) *Attorney, Agent, or Firm* — Cahill Glazer PLC

(57) ABSTRACT

A crossbow has a riser, flexible limbs, a bowstring extending between the tips of the limbs for propelling an arrow, and an elongated frame extending from the riser. A bowstring release proximate the rear end of the elongated frame includes a trigger for releasing the bowstring, and firing an arrow. A first grip is disposed proximate to the trigger for being grasped by the user's first hand. A "Picatinny" type support rail extends along and below the elongated frame, secured at its rearmost end to the elongated frame, but otherwise spaced therefrom. The support rail can receive fore-grips, a bi-pod, or can be rested against a support surface to help steady the crossbow during firing.

18 Claims, 12 Drawing Sheets

CROSSBOW STOCK HAVING LOWER FLOATING RAIL

CROSS-REFERENCE TO RELATED APPLICATIONS

The present application is a continuation-in-part of co-pending non-provisional U.S. patent application Ser. No. 12/350,106, filed on Jan. 7, 2009, entitled "Crossbow Accessory for Lower Receiver of Rifle and Related Method", assigned to the assignee of the present application, and the benefit of such earlier filing date is hereby claimed under 35 U.S.C. §120.

The present application is also related to co-pending application Ser. No. 12/350,123, filed on Jan. 7, 2009, and entitled "Release Assembly for Crossbow", assigned to the assignee of the present application.

The present application is related to a co-pending application Ser. No. 12/350,131, filed on Jan. 7, 2009, and entitled "Compact Winding Mechanism for Crossbow", assigned to the assignee of the present application.

BACKGROUND OF THE INVENTION

1. Field of the Invention

The present invention relates generally to crossbows, and more specifically, to a crossbow having a lower rail for receiving a fore-end grip or the like.

2. Description of the Related Art

One of the most popular sporting rifles in the U.S. and many other parts of the world is the AR-15 rifle. The term "AR-15" was originally an abbreviation for the Armalite Model 15, a semi-automatic rifle that is commercially available to civilians. While the term "AR-15" has seen used as a trademark by Colt, generic rifles that use the original AR-15 configuration are available from a large number of manufacturers. The AR-15 civilian semi-automatic rifle and the M4 military automatic rifle are built upon the same basic platform. Among the reasons that the AR-15 is so popular is that it is modular in design, and therefore highly configurable and customizable. There are many suppliers who sell accessory items to add to AR-15 style rifles, including telescopic sights, buttstocks, grips, and the like. In addition, the accuracy of the AR-15 has made it popular with sport shooters and hunters. In particular, the trigger assembly of the AR-15 rifle has proved to be highly reliable in the field. The number of such AR-15 style rifles that have been sold in the U.S. has been estimated at 8 to 12 million. Owners of such rifles are constantly on the look-out for new accessories to use with such rifles.

Crossbows have also long been known in the archery field for use in hunting game. Crossbows have higher draw weights than conventional archery bows and fire arrows (or "bolts") with greater speeds. As a result, crossbows usually have greater range than an archery bow. While there are some hunters own both a rifle and a crossbow, experienced hunters accustomed to hunting with rifles do not often branch into the use of crossbows, perhaps because they perceive that crossbows are too complex to operate.

When crossbows are configured for firing, the force exerted by the retracted bowstring can be in the range of approximately 100 to 200 pounds. A right-handed crossbow user typically positions a crossbow for firing by placing the butt end (often including a buttstock) of the crossbow against the user's right shoulder, grasping the trigger grip of the crossbow with the user's right hand, and grasping the barrel (or bolt rail) of the crossbow with the user's left hand ahead of the trigger. A left-handed user might do just the reverse. In either case, the user can better stabilize the crossbow by grasping the barrel forwardly of the trigger.

Due to advancements in technology and innovation, crossbows are capable of shooting arrows, or "bolts", at ever-increasing speeds, thereby extending the range, and accuracy, of such crossbows. As noted above, state-of-the-art crossbows are now capable of exerting a draw force of approximately 200 pounds on the arrow (or bolt) during release. On the other hand, as arrow speeds increase, the manner in which a crossbow is supported during firing can have a greater effect upon the flight of the fired arrow. In order to maintain repeatable arrow shots, the manner in which the crossbow is supported during firing must be consistent from shot to shot.

Obviously, users of crossbows have different body sizes and different arm spans. Accordingly, users tend to grab the forward stock of the crossbow at different points, depending upon their size and build. Even a particular user may inadvertently grasp the crossbow differently for each shot, positioning his or her forward-most hand at a slightly different point along the stock from one shot to the next. Alternatively, if a user is supporting the underside of the crossbow stock upon a sandbag, for example, the user might not engage the sandbag at exactly the same point along the crossbow stock from one shot to the next. These variations in firing position may not have mattered as much in the case of older crossbows that produced relatively slower arrow speeds. However, Applicants have found that the increasing arrow speeds, and extended shot distances, produced by state-of-the-art crossbows effectively multiply the impact of such subtle variations in the support of the crossbow, thereby introducing noticeable errors in shot placement from one shot to the next.

Within the world of firearms, it is known to provide a heat guard/rail structure surrounding the barrel of a rifle. A user of the firearm can grasp the trigger grip of the firearm with one hand, and can grasp the heat guard with his or her other hand, forwardly of the trigger. For example, in U.S. Pat. No. 5,343,650 to Swan, an extended rigid frame receiver sleeve for a firearm is disclosed having both upper and lower rails. Swan's extended rigid frame receiver sleeve is joined to the firearm receiver and extends forwardly therefrom, surrounding the barrel of the firearm, while being spaced apart from the barrel as the sleeve extends forward. Swan describes the barrel of the rifle as being "free floating" relative to the extended rigid frame receiver sleeve. Swan states that hand guards mounted on the rigid frame receiver sleeve, rather than on the barrel itself, provide a much cooler grip to the shooter. Swan also explains that the "floating" barrel arrangement ensures that heat will not be transferred from the barrel to sensitive optics, electronics and other sensitive elements mounted upon the rigid frame receiver sleeve. Swan also states that the rigid frame receiver sleeve isolates the barrel, and prevents hand, sling, and bi-pod pressure from deflecting the barrel of the firearm; Swan further states that the free floating barrel avoids outside forces that could deflect the point of aim.

Unlike firearms, crossbows do not generate significant amounts of heat. Thus, in the case of crossbows, there is no need to isolate heat from the user's hands or from sensitive optics, and techniques used by firearm makers to isolate the heat of the barrel from a user's hands and/or accessories are not applicable. Moreover, until recently, crossbow firing speeds, shooting distances, and general accuracy, were all so limited that variations in the placement of the user's hands on the crossbow, or variations in the manner in which the crossbow was supported by a sandbag, bi-pod, or the like, were relatively insignificant. Accordingly, techniques used by firearm makers to prevent hand pressure or bi-pod pressure from deflecting the barrel of a firearm would not appear to be relevant to crossbows.

Accordingly, it is an object of the present invention to provide a crossbow adapted to be grasped by both hands of a user during firing while minimizing any variation in arrow flight that might otherwise result from the user's change of fore-end grip from one shot to the next.

Another object of the present invention is to provide a crossbow adapted to be partially supported by a bi-pod, sandbag, or the like during firing, while minimizing any variation in arrow flight, from one shot to the next, that might otherwise result from shifting the point at which the crossbow contacts the bi-pod, sandbag, or other stabilizing support.

Still another object of the present invention is to provide such a crossbow which achieves relatively consistent arrow placement for users of varying body builds and arm spans.

These and other objects of the present invention will become more apparent to those skilled in the art as the description thereof proceeds.

SUMMARY OF THE INVENTION

Briefly described, and in accordance with a preferred embodiment thereof, the present invention relates to a crossbow assembly including a riser (or "prod") and first and second flexible limbs coupled to opposing end portions of the riser, a bowstring extending between opposing limb tips of the first and second limbs for propelling an arrow, and an elongated frame member, or stock, the front end of which is coupled to a central portion of the riser. The crossbow further includes a bowstring release coupled to a rear end of the elongated frame member, the bowstring release having a trigger adapted to be operated by a finger on a user's first hand for selectively releasing the bowstring when a user pulls the trigger. A first grip is disposed proximate to the trigger for being grasped by the user's first hand. A support rail extends along and below the elongated frame member. The rear end of the support rail is secured generally proximate to the rear end of the elongated frame member; the front end of the support rail extends forwardly generally toward the front end of the elongated frame member but spaced apart therefrom.

The support rail is adapted to assist the user in supporting the crossbow during release of the bowstring. For example, a right-handed user may grasp the support rail directly with the user's left hand. On the other hand, one or more support members, such as a fore-grip member, may be secured along the support rail, and the user may grasp one of such fore-grip members to help steady the crossbow during firing. Alternatively, a support member in the form of a bi-pod may be secured along the support rail to help steady the crossbow during firing. Optionally, the support rail can be rested upon a sandbag or other stable support structure to help steady the crossbow during firing. Preferably, the support rail is configured so that such accessory support members can slide over, and clamp onto, the support rail. In any of these cases, since the support rail is always secured to the same point on the elongated frame member of the crossbow, variations in the positioning of the user's forward hand, fore-grip, bi-pod, sandbag, etc., along the support rail minimize the effect on the firing characteristics of the crossbow.

In the preferred embodiment of the invention, the aforementioned support rail is formed integrally as one piece with the elongated frame member. Preferably, the support rail is formed as a so-called "Picatinny rail", generally corresponding to MIL-STD-1913, and having a generally T-shaped cross-section, including a series of ridges interspersed with flat spacing slots. The Picatinny rail provides a standardized mounting platform, onto which fore-grips, bi-pods, or other accessories may easily be secured, as by sliding and clamping such items onto the support rail.

DETAILED DESCRIPTION OF THE PREFERRED EMBODIMENTS

Figure 1:
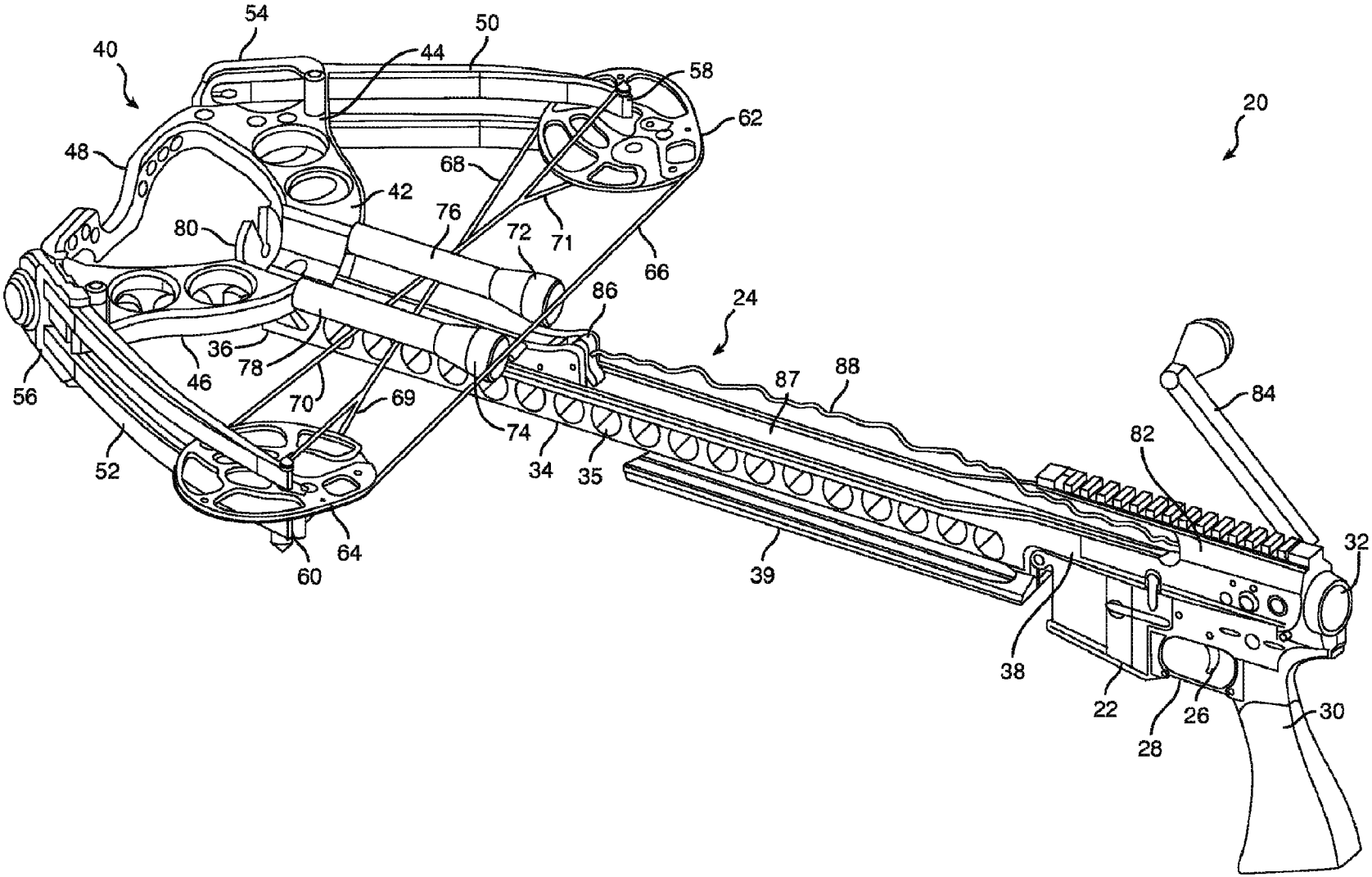
FIG. 1 is a perspective view of a crossbow accessory in accordance with a preferred embodiment of the present invention.

FIG. 1 shows a crossbow, designated generally by reference numeral 20, and including the modular lower receiver 22 of an AR-15 style rifle attached to crossbow accessory 24. While the preferred embodiment uses an AR-15 style lower receiver 22, those skilled in the art will appreciate that the lower receivers of other models of rifles may also be used. In addition, while the described embodiment is a crossbow accessory for an existing lower receiver already owned by a user, those skilled in the art will appreciate that the described crossbow assembly may integrally incorporate the components of such lower receiver into the crossbow if desired.

As is known to gun enthusiasts, lower receiver 22 includes a finger trigger 26 which extends downwardly from the housing of lower receiver 22. A trigger guard 28 may also be included. A pistol grip 30 is also preferably provided along with lower receiver 22. The rear end of lower receiver 22 includes a threaded opening 32 adapted to receive a removable buttstock. For example, a buttstock of the type shown and described in U.S. Pat. No. 7,363,740 to Kincel, may be threadedly engaged with the threaded opening 32 of lower receiver 22. The addition of such a buttstock allows for positioning crossbow 20 against the user's shoulder for increased accuracy.

While not illustrated in FIG. 1, lower receiver 22 also houses a spring-biased hammer that may be cocked into a firing position and subsequently released by pulling trigger 26. The structure and operation of the trigger, hammer, and a related "disconnector" used in a conventional AR-15 style lower receiver are described and illustrated within U.S. Pat. No. 5,680,724 (Peterken) and U.S. Pat. No. 6,722,072 (McCormick), the disclosures of which are hereby incorporated by reference. The hammer is ordinarily used to strike a firing pin on an ammunition casing to fire a bullet.

Turning to crossbow accessory 24, an elongated frame member 34, preferably made of aluminum, extends between a first end 36 and a second opposing end 38. Frame member 34 generally corresponds to the stock, barrel, or main rail, of a conventional crossbow. Openings, such as circular opening 35, may be machined along frame member 34 to lessen the weight thereof. A grooved accessory mounting rail 39, sometimes called a "Picatinny" rail", is provided along the bottom of frame member 34 for mounting hand grips or other modular accessories often sold for use with AR-15 style rifles. Additional aspects of rail 39 are described in greater detail below.

The first, or forward-most, end 36 of frame member 34 is secured to a riser 40. Riser 40 includes a central portion 42 and opposing end portions 44 and 46. A conventional foot stirrup portion 48 may also be formed integrally with riser 40, if desired. Riser 40 is preferably formed of machined aluminum. First and second flexible limbs 50 and 52 extend from end portions 44 and 46, respectively, of riser 40. As illustrated, limbs 50 and 52 are each preferably formed as "split limbs". Preferably, split limbs 50 and 52 are secured to riser end portions 44 and 46 by pivoting pocket members 54 and 56, respectively. Split limbs 50 and 52 are preferably formed of fiberglass. Limb 50 has a limb tip 58, and limb 52 has a limb tip 60.

In the preferred embodiment, first and second pulleys, preferably in the form of power cams, 62 and 64 are rotatably mounted at limb tips 58 and 60, respectively. As used herein, the term "pulley" is intended to include both circular pulleys and non-circular cams. Pulleys 62 and 64 are preferably formed of machined aluminum. It is possible to form a crossbow, in accordance with the present invention, without the use of cams or pulleys, corresponding to a conventional recurve archery bow wherein the bowstring extends directly from one limb tip to the opposing limb tip. However, the use of cams/pulleys 62 and 64 is preferred for improved performance. As used herein, a description of the bowstring 66 extending between the limb tips of the first and second limbs 50 and 52 should be understood to be inclusive of both simple recurve-style bows (without any cams or pulleys) and compound-style bows (having cams or pulleys rotatably supported at the limb tips).

A bowstring 66 extends between pulleys 62 and 64 for propelling an arrow, or "bolt". In addition, a pair of power cables, or tension cables, 68 and 70 also engage pulleys 62 and 64 to maximize the efficiency of the force applied to the arrow by bowstring 66 as an arrow is fired. Power cable 68 extends from a groove on pulley 62 to a split cable harness 69 secured to the pivot axle of opposing pulley 64. Likewise, power cable 70 extends from a groove on pulley 64 to a split harness 71 secured to the pivot axle of opposing pulley 62. As bowstring 66 is retracted toward second end 38 of frame member 34, additional portions of bowstring 66 play off of pulleys 62 and 64, while pulleys 62 and 64 wind additional portions of power cables 68 and 70. When bowstring 66 is released from a drawn position, pulleys 62 and 64 wind additional portions of bowstring 66, while power cables 68 and 70 unwind from pulleys 62 and 64. Bowstring 66, and power cables 68 and 70, are preferably made from a blend of braided Dyneema/Vectran high-molecular weight cord. The braided string and cables each preferably include 16 strands of such cord braided together. Bowstring 66 preferably has a "D-loop" 67 (see FIG. 18A) attached thereto at the nocking point, i.e., at the point where the arrow nock is engaged with bowstring 66. This D-loop 67 is engaged by a bowstring hook 162 of a bowstring release 86 in a manner described in greater detail below.

Still referring to FIG. 1, a pair of rubber stoppers 72 and 74 are positioned adjacent bowstring 66 (when bowstring 66 is at rest). Rubber stoppers 72 and 74 are supported by cylindrical rods 76 and 78, respectively, which are, in turn, attached to riser 40. Ideally, power take up cables 68 and 70 extend below and around rods 76 and 78. In this manner, rods 76 and 78 function as cable guides to deflect cables 68 and 70 away from the path of an arrow being fired. Rubber stoppers 72 and 74 serve to dampen the force of the bowstring after an arrow is fired from the crossbow.

In the preferred embodiment, the crossbow provided herein is of a "rail-less" type, meaning that the arrow being fired by the crossbow does not slide along a rail as it is being released from the crossbow. By making the crossbow rail-less, frictional drag on the arrow is reduced. The only support for the arrow being fired is provided at the rear of the arrow, where the nock of the arrow is engaged by bowstring 66, and by an arrow rest 80 secured to riser 40. The upper surface of frame member 34 preferably includes a channel 87, but channel 87 is not used to support the arrow as the arrow is being fired.

Also depicted within FIG. 1 is an upper housing 82, a removable crank arm 84, a bowstring release 86 and a retractor rope 88. Bowstring release 86 is guided by channel 87 formed upon the upper surface of frame member 34. Additional details regarding upper housing 82, crank arm 84, bowstring release 86, and retractor rope 88, are provided herein. Retractor rope 88 is preferably made from a braided Dyneema ("Spectra") high-molecular weight cord having a diameter of 7/64 inch and rated at 1,400 pounds of tensile pull breaking strength. This allows the rope spool to be kept compact and yet is strong enough to avoid breakage under the 170 pound force exerted by the bowstring.

Figure 2A:
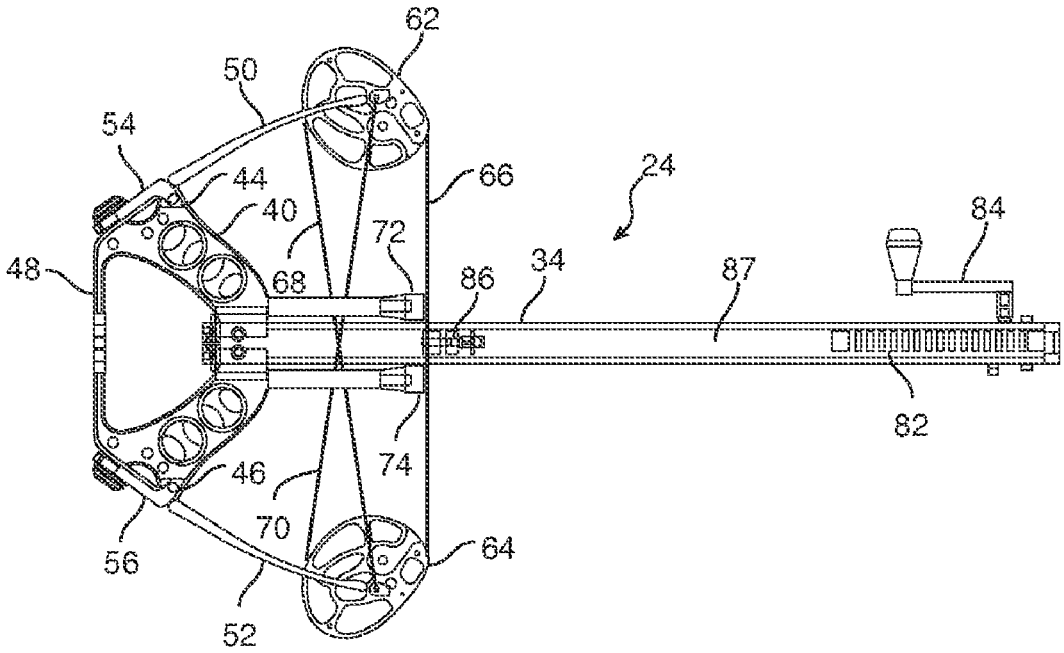
FIG. 2A is a top view of the crossbow accessory shown in FIG. 1 with the bowstring in its rest position, and with a crank arm attached to the bowstring retraction mechanism.
Figure 2B:
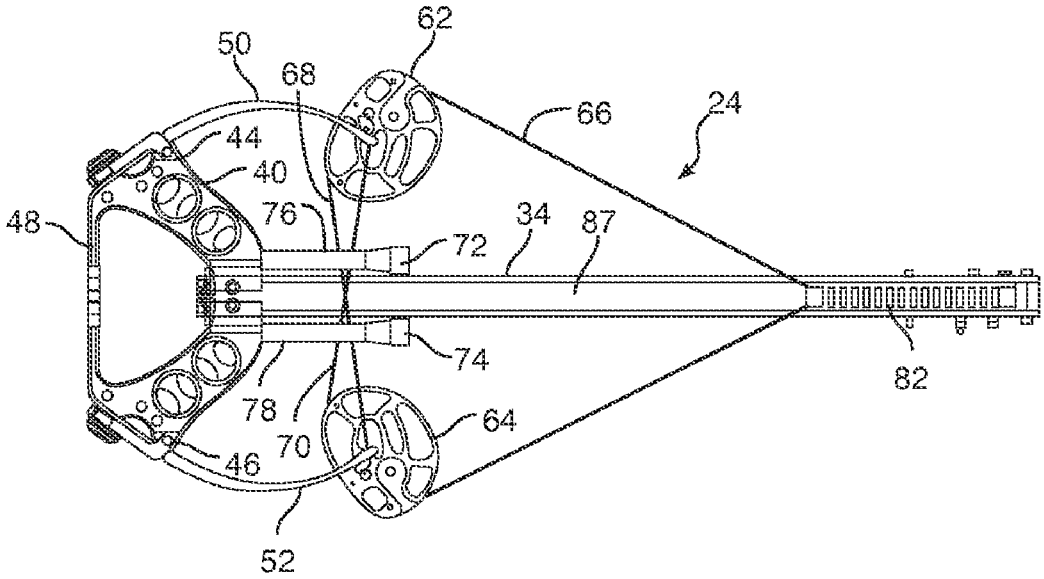
FIG. 2B is a top view of the crossbow accessory shown in FIG. 1 with the bow in its fully-drawn position, and with the crank arm removed from the bowstring retraction mechanism.

FIGS. 2A and 2B are top views of the crossbow accessory 24 shown in FIG. 1. In FIG. 2A, crossbow accessory 24 is shown with the bowstring in its rest position (at "brace height"), and with crank arm 84 attached to the bowstring retraction mechanism for retracting bowstring release 86 and bowstring 66. In FIG. 2B, crossbow accessory 24 is shown in its fully-drawn position, wherein bowstring release 86 is hidden within upper housing 82, and with crank arm 84 having been removed from the bowstring retraction mechanism.

Figure 3:
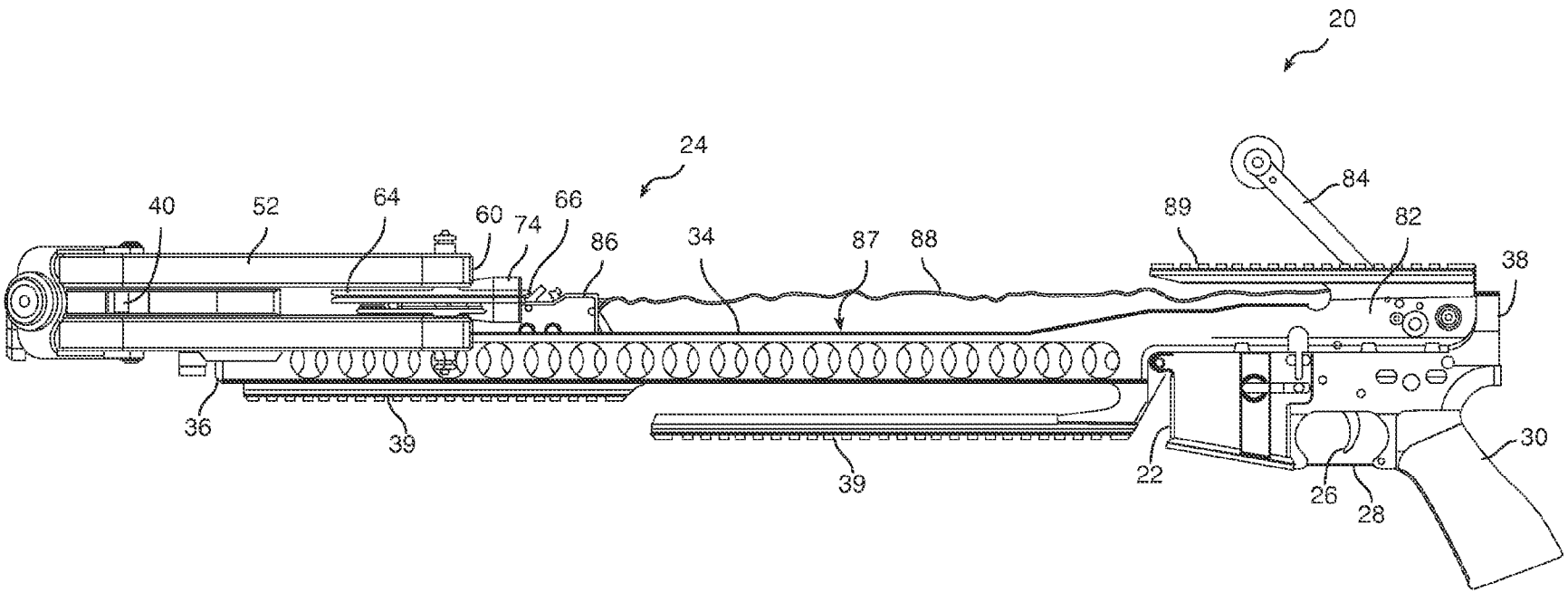
FIG. 3 is a side view of the crossbow accessory shown in FIGS. 1 and 2A with the bow in its rest position, and with a crank arm attached to the bowstring retraction mechanism.

The side view shown in FIG. 3 of crossbow 20, lower receiver 22 and crossbow accessory 24 shows many of the same components already described in regard to FIG. 1. Retractor rope 88 has been pulled out of upper housing 82 by a sufficient length to permit bowstring release to move forwardly along channel 87 to engage bowstring 66. Grooved accessory mounting rail 39 extends along and below a central portion of frame member 34; optionally, a further grooved accessory mounting rail 39' may extend along the bottom of the frontmost portion of frame member 34. Similarly, a grooved accessory mounting rail 89 may be provided along the top surface of upper housing 84 to facilitate the mounting of a telescopic sight, laser pointers, other optics, etc.

Figure 4:
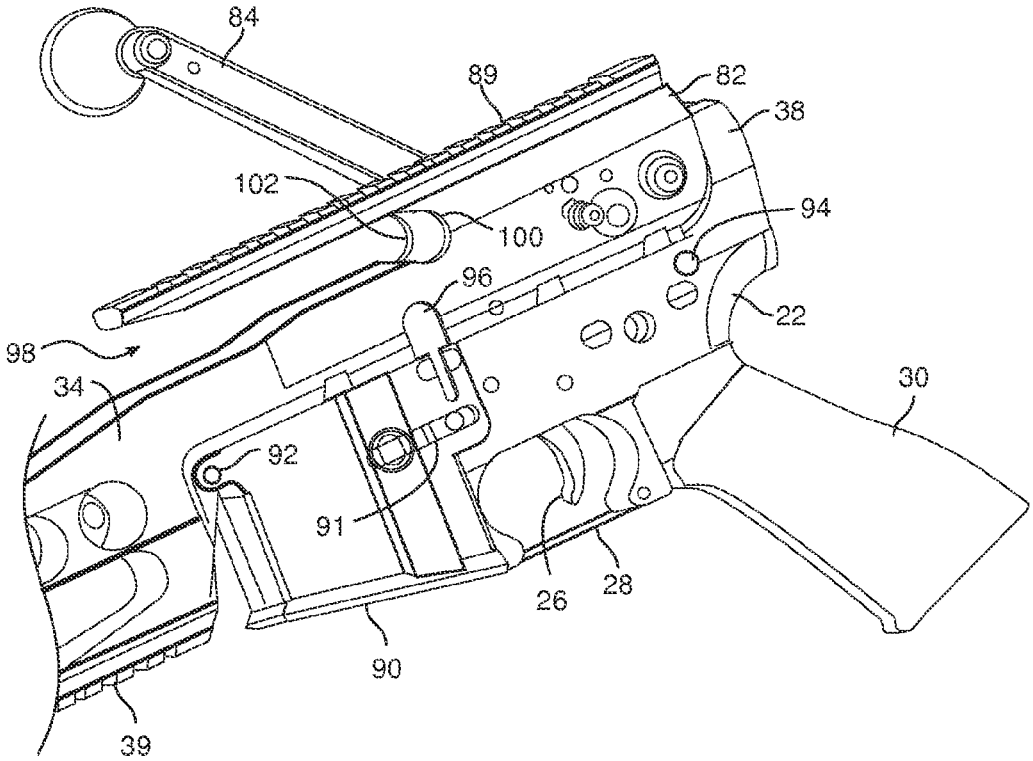
FIG. 4 is an enlarged partial perspective view of an AR-15 lower receiver attached to the second end of the elongated frame member of the crossbow accessory, and illustrating an upper housing of the crossbow accessory.
Figure 5:
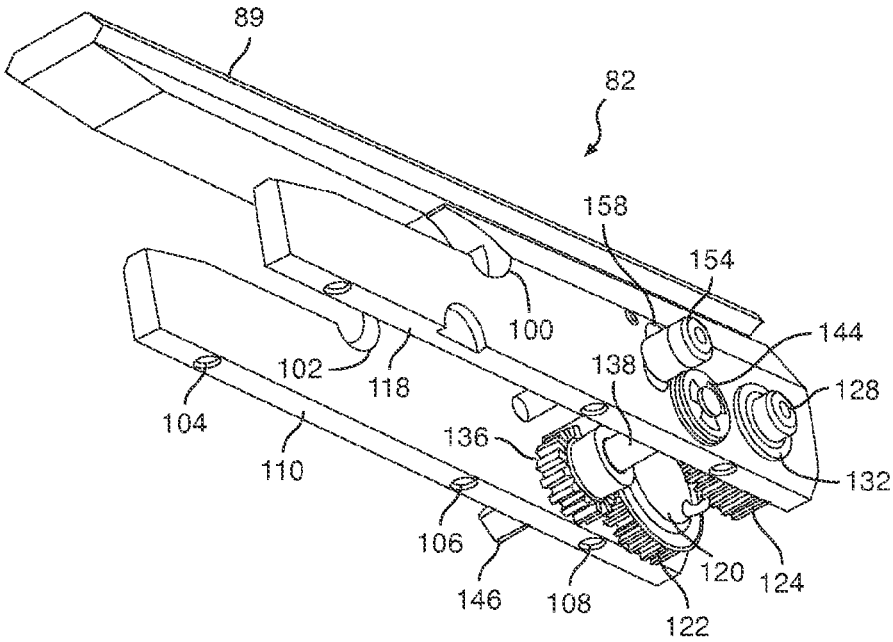
FIG. 5 is a perspective view of the upper housing, viewed from below, and prior to attachment to the second end of the elongated frame member of the crossbow accessory.

Referring to FIG. 4, lower receiver 22 include a magazine port 90 which ordinarily receives an ammunition magazine, but which is not used when crossbow accessory 24 is attached to lower receiver 22. Likewise, the "magazine catch" 91 is also left unused when crossbow accessory 24 is being used. Similarly, "bolt catch" 96 is not needed when crossbow accessory 24 is in use.

Lower receiver 22 is attached to the rear end of frame member 38 by two pins. The forward-most pin 92 is typically referred to as the "receiver pivot pin", and extends through mating holes in lower receiver 22 and second end 38 of frame member 34. The receiver pivot pin is engaged from the opposite side by a receiver pivot pin screw to prevent the receiver pivot pin from falling out unintentionally. The rearmost pin 94 is typically referred to as the "take down pin". The take down pin again extends through mating holes in lower receiver 22 and second end 38 of frame member 34. A spring-biased detent pin (not shown) engages the take down pin laterally along its shaft to prevent the take down pin from being removed unintentionally. These same two pins are conventionally used to attach lower receiver 22 to other AR-15 style modular rifle components.

Still referring to FIG. 4, it will be noted that upper housing 82 includes a throat 98 adapted to receive bowstring release 86. Throat 98 terminates in a pair of generally circular cut-outs 100 and 102 formed in the opposing sidewalls of upper housing 82. As will be explained in greater detail below, alignment pins extending from opposing sides of bowstring release 86 engage cut-outs 100 and 102 for seating bowstring release in a fixed position when bowstring release 86 is retracted into upper housing 82. Because bowstring release 86 is retracted into the same fixed, drawn position in upper housing 82 each time that bowstring 66 is retracted, the power stroke of the crossbow is always the same each time the crossbow is fired.

FIGS. 5-10 generally illustrate the features of upper housing 82. Upper housing 82 is preferably made from machined aluminum. As shown best in FIGS. 5 and 9A, a series of threaded mounting holes extend upwardly into side wall 110 of upper housing 82 for receiving corresponding attachment screws 112, 114 and 116, respectively, used to attach side wall 110 of upper housing 82 to second end 38 of frame member 34. Similar mounting holes are provided in opposing side wall 118.

Figure 6:
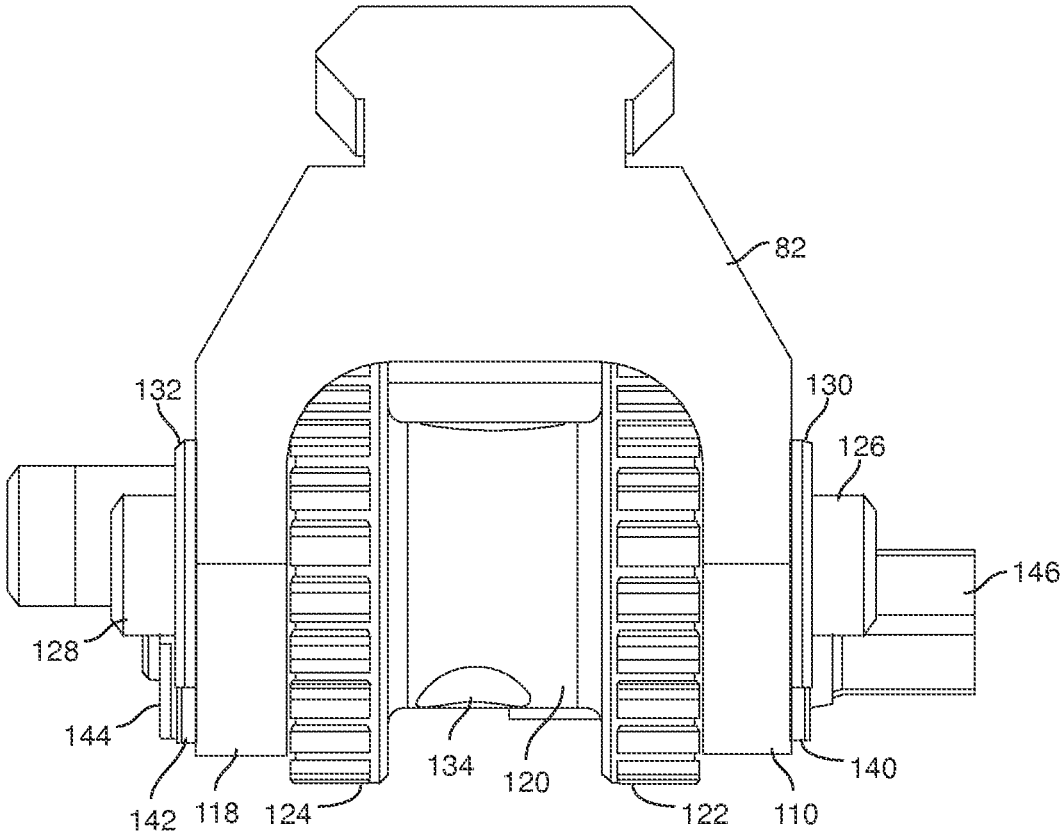
FIG. 6 is a rear view of the upper housing shown in FIG. 5, and illustrating a rope spool rotatably supported therein.
Figure 7:
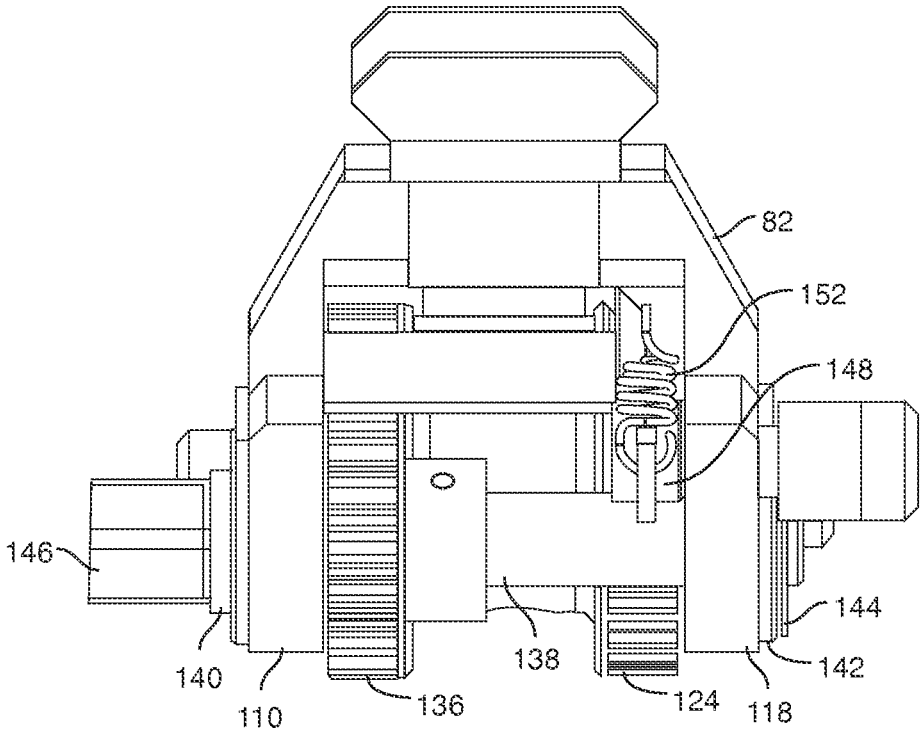
FIG. 7 is a front view of the upper housing shown in FIG. 5, and illustrating a spur gear and drive axle used to rotate the rope spool.
Figure 8:
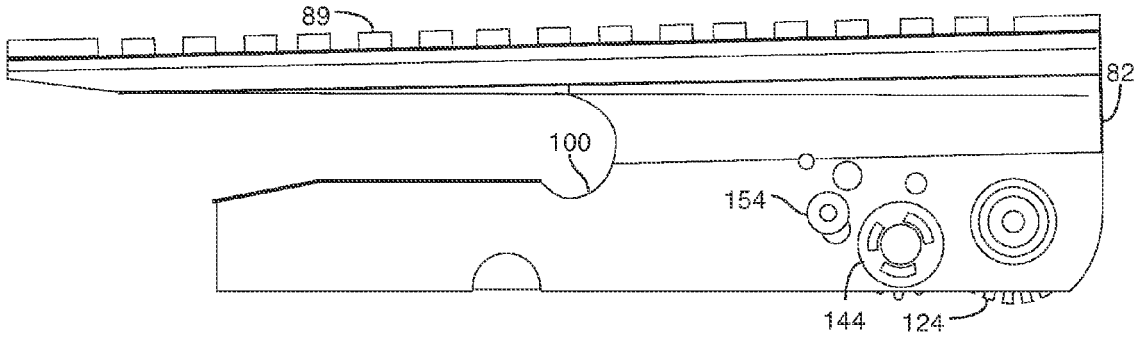
FIG. 8 is a side view of the upper housing shown in FIG. 5.
Figure 10:
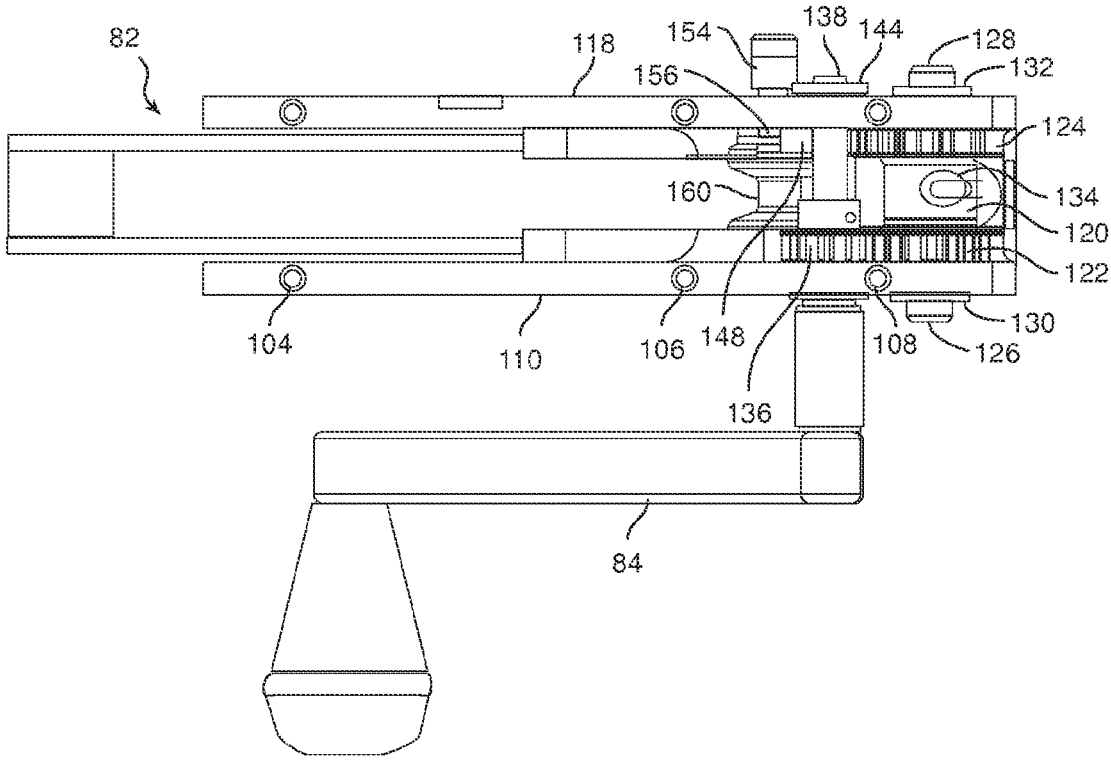
FIG. 10 is a bottom view of the upper housing with the crank arm attached, and the pawl disengaged.

Apart from serving to properly guide bowstring release 86 into its fully-drawn position, upper housing 82 also preferably contains the components used to retract bowstring release 86, and bowstring 66 engaged therewith, away from the riser into the fully-drawn position proximate second end 38 of frame member 34. Referring briefly to FIGS. 6 and 10, a rope spool 120 is formed between a pair of gears 122 and 124. In the preferred embodiment, spool 120 and gears 122 and 124 are integrally machined from hardened tool steel rated at 250 KSI (1,000 psi). Spool 120 and associated gears 122 and 124 are rotatably supported between side walls 110 and 118 of upper housing 82 by a pair of bolts 126 and 128 which extend through holes formed in such side walls into threaded holes formed in the centers of gears 122 and 124. Smooth portions of the shafts of bolts 126 and 128 are supported by bearings 130 and 132, respectively, which bearings are supported within the aforementioned holes formed in the side walls 110 and 118 of upper housing 82. Preferably, spool 120 has a hole 134 formed transversely therethrough for receiving the first end of the refractor rope 88.

In order to rotate spool 120 when retracting rope 88, a spur gear 136 is engaged with spool gear 122. Spur gear 136 is attached to drive axle 138. Drive axle 138 is rotatably supported between side walls 110 and 118 of upper housing 82. Holes are formed in side walls 110 and 118 to accommodate bearings 140 and 142 that rotatably support drive axle 138. A retainer clip 144 is secured over one end of drive axle 138 to retain drive axle 138 within upper housing 82. The opposite end of drive axle 138 includes a square-shaped head 146 for releasably receiving winding crank arm 84. After attaching crank arm 84 over square-shaped head 146, crank arm 84 is rotated to rotate drive axle 138 and spur gear 136, which rotates spool gear 122 and spool 120 to wind rope 88 thereabout. Spur gear 136 includes 14 gear teeth, while spool gears 122 and 124 each include 22 teeth. Accordingly, the force that needs to be applied by a user to crank arm 84 in order to retract bowstring 66 is reduced by the mechanical advantage of the gear ratio 14:22. Crank arm 84 is preferably about five inches in length, compared to the much smaller diameters of gears 136, 122 and 124, and rope spool 120, providing a further mechanical advantage.

Figure 11:
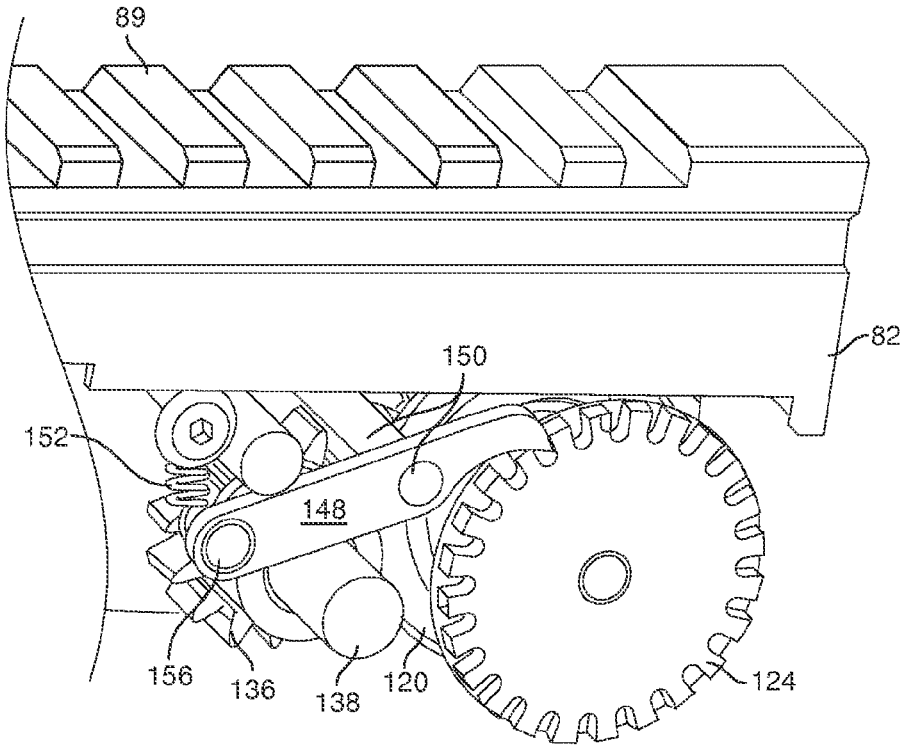
FIG. 11 is an enlarged perspective, sectional view of the gearing and pawl used to wind, and retain, the rope upon the rope spool.
Figure 12:
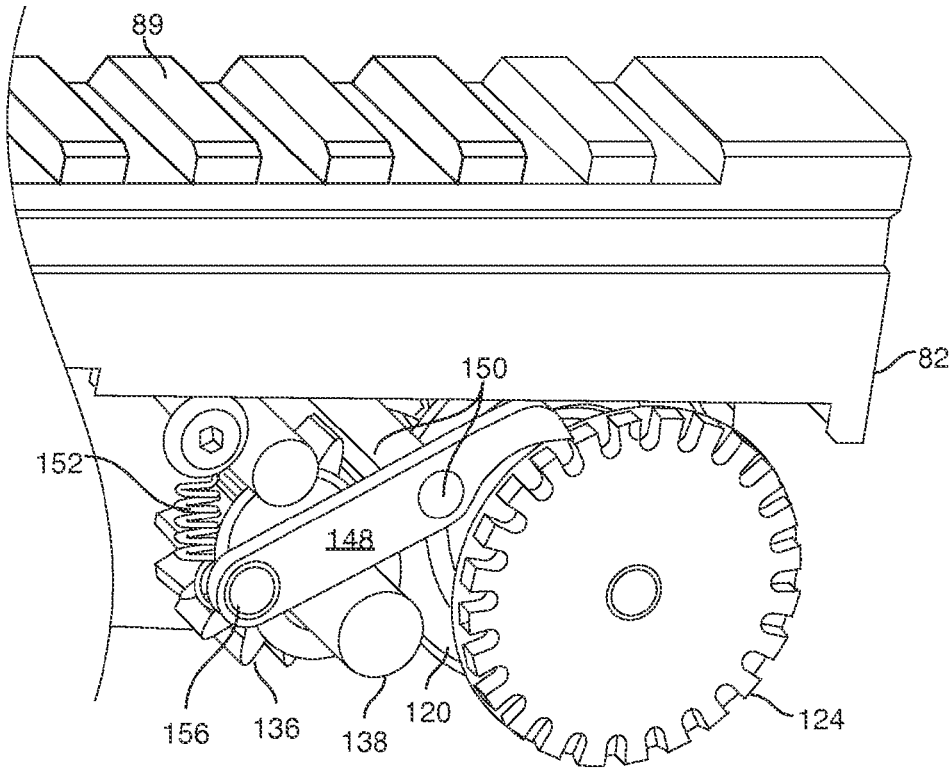
FIG. 12 is a an enlarged view similar to FIG. 11 but with the pawl released for allowing the bowstring release and rope to be withdrawn from the upper housing.

In the absence of any other components, were the user to let go of crank arm 84 after retracting the bowstring, then rope 88 would be pulled back off of spool 120 by the force of the bowstring. To prevent this from happening, a spring-biased pawl 148 is ordinarily engaged with spool gear 124. As shown best in FIG. 11, pawl 148 is mounted for pivotal movement about pin 150 which extends between side walls 110 and 118. Pawl 148 can pivot between an engaged position (see FIGS. 9A and 11) and a released position (see FIGS. 9B and 12). Biasing spring 152 normally pulls pawl 148 into engagement with spool gear 124; in that case, spool gear 124 may be rotated clockwise (relative to FIGS. 5, 9A, and 11), but not counter-clockwise. The retractor rope winds about the top of spool 120 as crank arm 84 is rotated. If crank arm 84 is released, pawl 148 engages a tooth of spool gear 124, preventing spool 120 from turning in the opposite direction, and preventing rope 88 from unwinding from spool 120.

Figure 9A:
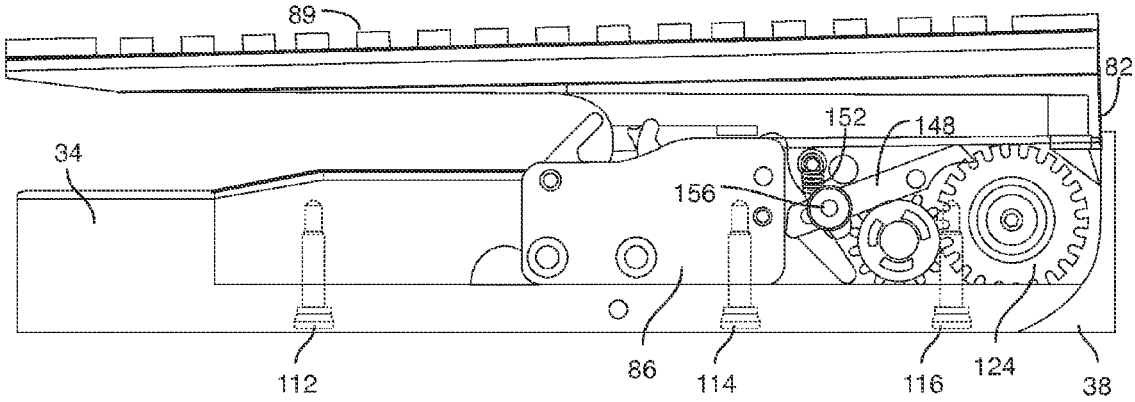
FIG. 9A is a cross-sectional view of the upper housing shown in FIG. 8 wherein a bowstring release has been retracted into the upper housing into its proper drawn position for firing, and wherein a pawl engages one the rope spool gears.
Figure 9B:
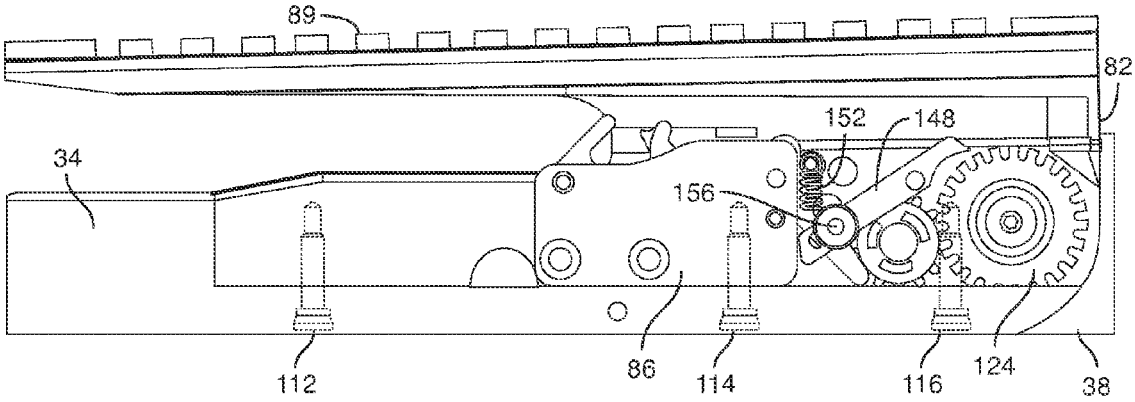
FIG. 9B is a cross-sectional view similar to FIG. 9A but wherein the bowstring release has seen retracted into the upper housing beyond its proper drawn position, and wherein the pawl is disengaged from the rope spool gear.

Referring briefly to FIGS. 9A and 9B, bowstring release 86 is shown received within upper housing 82. In FIG. 9A, bowstring release 86 has been advanced to its proper fully-drawn position, and is ready for firing. In some instances, represented by FIG. 9B, bowstring release 86 may actually be retracted too far into upper housing 82, i.e., beyond to its proper fully-drawn position. However, as shown in FIG. 9B, this causes the rearmost edge of bowstring release 86 to engage the forward-most end of pawl 148, thereby pivoting pawl 148 out of engagement with spool gear 124. As a result, when a user releases crank arm 84, a small amount of rope will unwind from spool 120 until bowstring release 86 no longer engages pawl 148. Spring 152 then forces pawl 148 back into engagement with spool gear 124, thereby ensuring that bowstring release 86 will revert to its proper fully-drawn position.

After firing an arrow from crossbow 20, a user will need to remove bowstring release 86, and retractor rope 88, from upper housing 82 in order to again retract bowstring 66 for the next shot. However, pawl 148 prevents spool 120 from unwinding rope 88 therefrom. Accordingly, a pawl release knob 154 extends from upper housing 82 for allowing the user to forcibly disengage pawl 148 from spool gear 124 to free spool 120. Pawl release knob 154 is attached to a pin 156 that extends through a vertical slot 158 (see FIG. 5) formed in side wall 118 of upper housing 82. Pin 156 is coupled to the forward-most end of pawl 148. When a user pushes pawl release knob downwardly, against the biasing force of spring 152, pin 156 forces the forward-most end of pawl 148 downward, thereby pivoting the rear end of pawl 148 upward, and away from spool gear 124. Thus, if the user pushes down on pawl release knob while withdrawing bowstring release 86 from upper housing 82, the rope retractor assembly will not offer any resistance to such movement.

While not essential, a guide pulley 160 (see FIG. 10), preferably formed of brass, may be rotatably supported within upper housing 82 between side walls 110 and 118 to help guide rope 88 toward spool 120. In addition, those skilled in the art will appreciate that crank arm 84 could, if desired, be used to directly drive rope spool 120 without the aid of a spur gear. While this direct drive approach loses the mechanical advantage provided by spur gear 136, a direct drive system may be suited to crossbows having lesser draw weights. For direct drive, spur gear 136, drive axle 138, and spool gear 122 would be eliminated. The square shaped head 146 would be moved to an extension of a rope spool axle, and crank arm 84 would then be removably connected directly to the rope spool axle. Spool gear 124, and pawl 148 would be retained to prevent rope spool 120 from unwinding rope 88 unintentionally.

Figure 13:
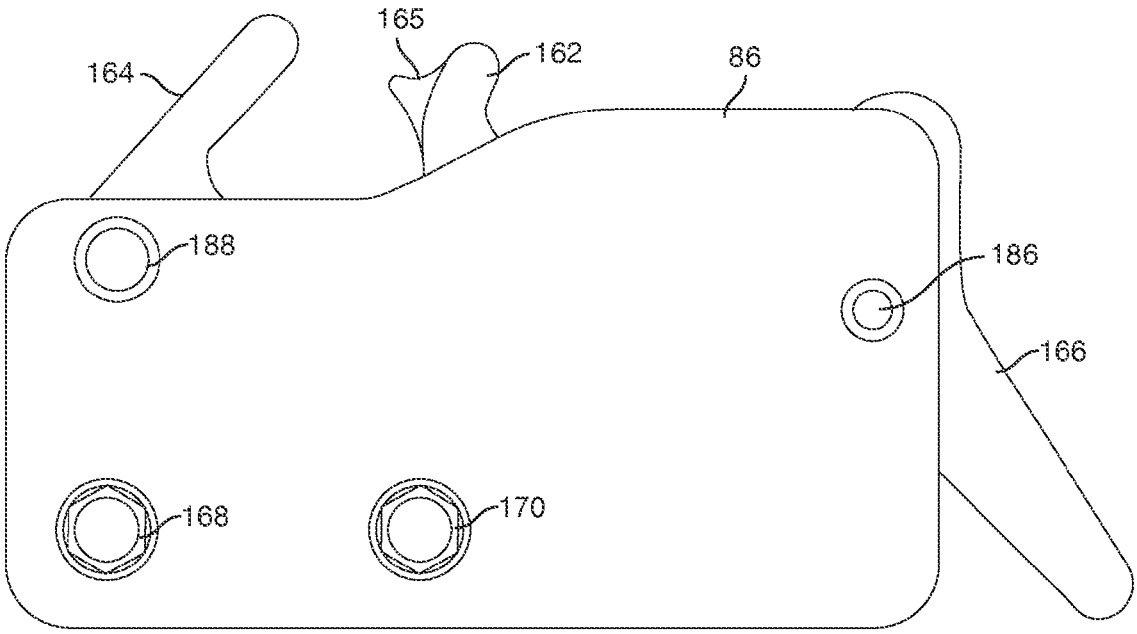
FIG. 13 is a side view of the bowstring release assembly isolated from the other components of the bowstring accessory.
Figure 14:
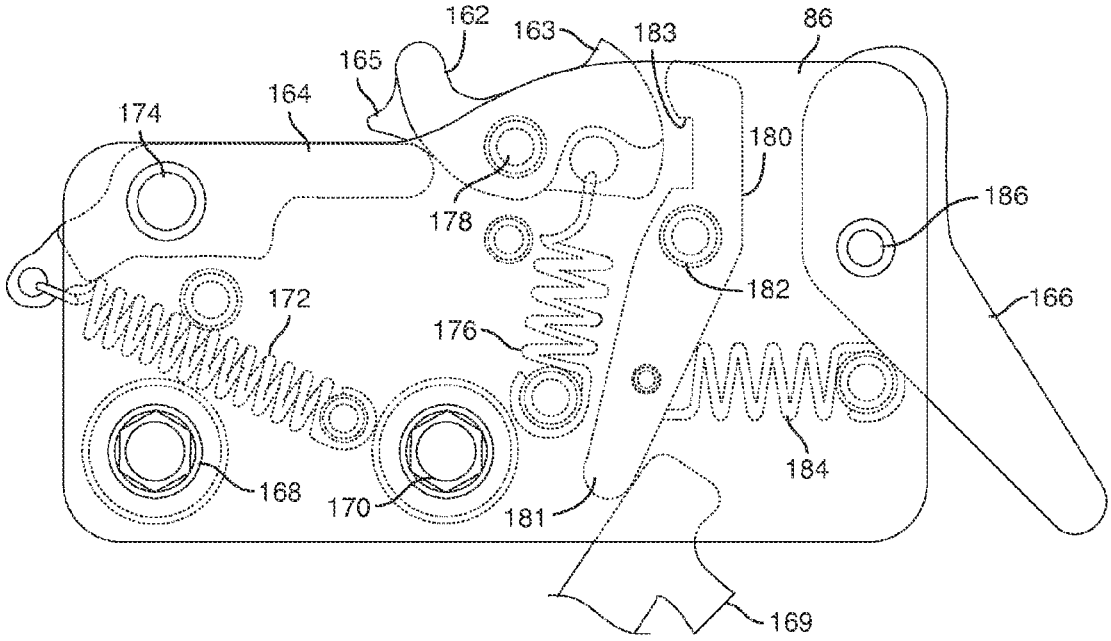
FIG. 14 is a cross-sectional view of the bowstring release assembly shown in FIG. 13, after an arrow is fired.

Turning now to FIGS. 13-18, bowstring release 86 will be described in greater detail. Bowstring release 86 includes a bowstring hook 162, an anti-dry fire (ADF) catch 164, and a cocking lever 166, all of which are pivotally mounted within bowstring release 86. Screws help to secure bowstring release 86 together. As shown in FIG. 14, bias spring tends to pull ADF catch 164 to its upward position, or counter-clockwise about its pivot pin 174 relative to FIG. 14. Bias spring 176 tends to pull bowstring hook 162 upwardly, or clockwise about its pivot pin 178. Sear member 180 does not protrude from bowstring release 86; sear member 180 pivots about pivot pin 182 and is biased in a counter-clockwise direction, relative to FIG. 14, by bias spring 184. Cocking lever 166 (also referred to herein as a "cocking bar") pivots about pivot pin 186 and does not require a biasing spring.

Figure 16:
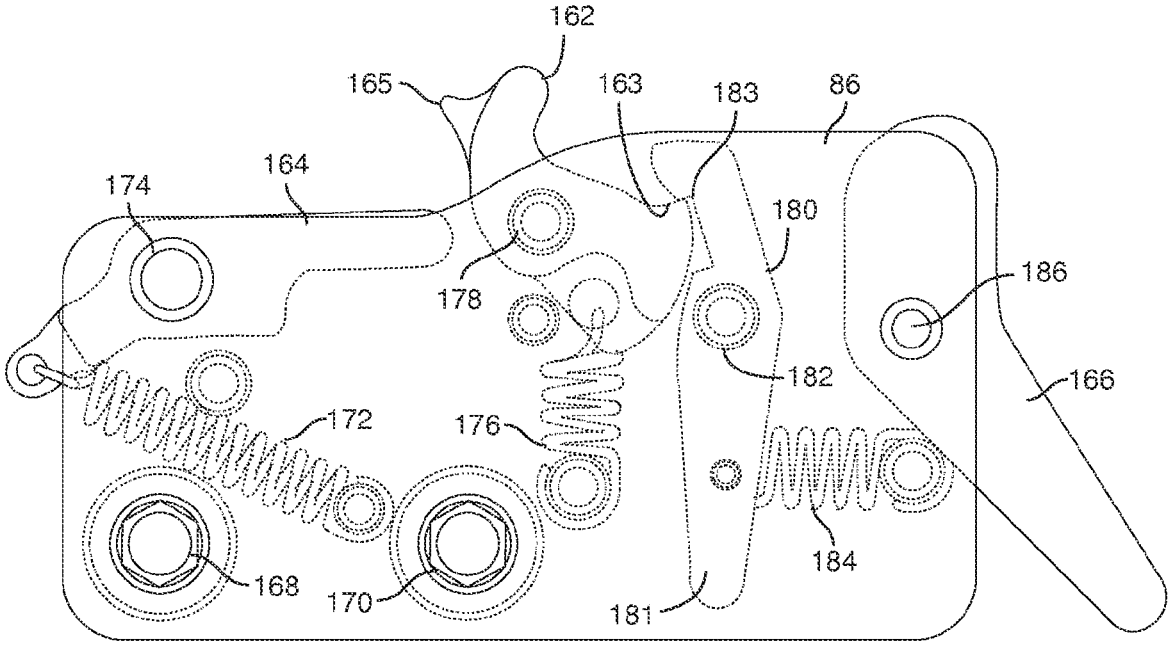
FIG. 16 is a cross-sectional view of the bowstring release assembly shown in FIG. 13, and wherein the bowstring release is armed and ready for firing.

FIG. 16 shows the relationship of the bowstring release components immediately before an arrow is fired. The aforementioned D-loop 67 formed on bowstring 66 (see FIG. 18A) is engaged by bowstring hook 162, and an arrow (not shown in FIG. 16) is nocked with bowstring 66. Bowstring release 86 has been retracted into its drawn position within upper housing 82. ADF catch 164 is depressed to a horizontal configuration, against the force of bias spring 172, by the presence of the arrow nocked with bowstring 66. Bowstring hook 162 includes a sear edge 163 engaged with sear edge 183 on sear member 180. Bias spring 184 is pulling on the lower end 181 of sear member 180 to keep sear edges 163 and 183 engaged. Bias spring 176, which ordinarily pulls bowstring hook 162 clockwise (relative to FIG. 16) is essentially ineffective since bowstring 66 is pulling bowstring hook 162 in a counter-clockwise direction (relative to FIG. 16) with much greater force. Bowstring release 86 is positioned within upper housing 82, and proximate the second end 38 of frame member 34 such that the lower end of sear member 181 lies adjacent to the path of the hammer of lower receiver 22.

FIG. 14 shows the relationship of the bowstring release components immediately after an arrow is fired. When the trigger 26 of lower receiver 22 is pulled, hammer 169 of lower receiver 22 swings forward, striking the lower end of sear member 181 with a force tending to rotate sear member 181 in a clockwise direction relative to FIG. 14. Accordingly, sear edge 183 of sear member 180 is disengaged from sear edge 163 of bowstring hook 162. The force exerted by the D-loop 67 (approximately 170 pounds) rapidly pulls bowstring hook 162 in a counter-clockwise direction, releasing the bowstring 66 from bowstring release 86.

Figure 15:
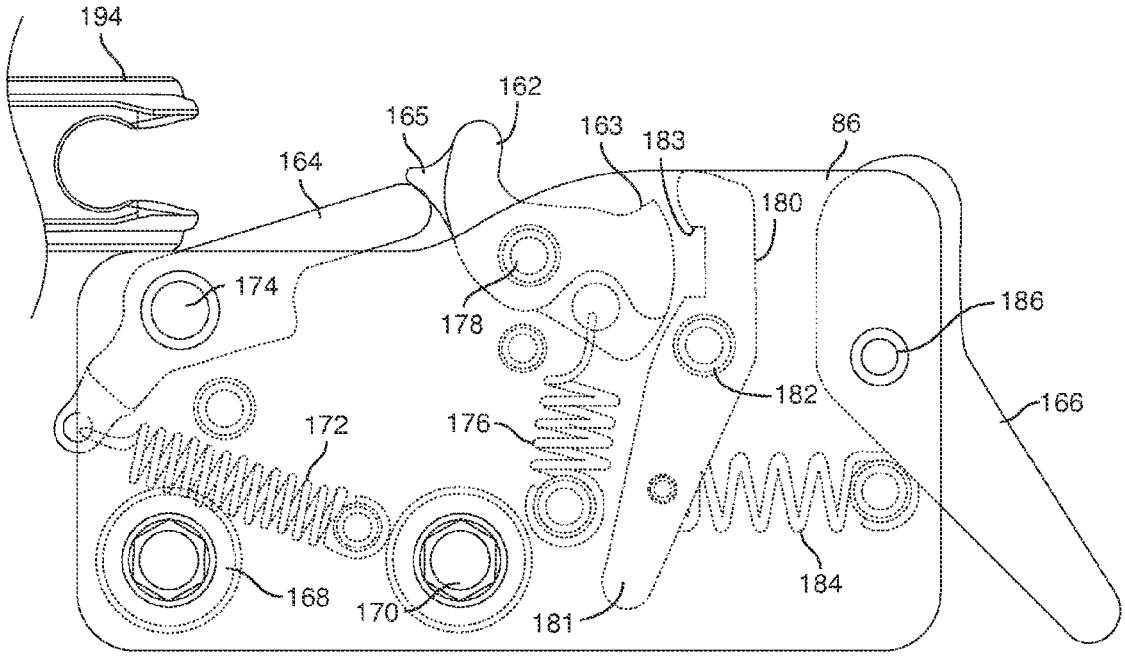
FIG. 15 is a cross-sectional view of the bowstring release assembly shown in FIG. 13, illustrating how the bowstring hook retards an ADF catch from rising prematurely immediately after the bowstring is released.

As noted above, bowstring release includes an anti-dry fire mechanism wherein ADF catch 164 prevents the release of D-loop 67 attached to bowstring 66 if no arrow is properly nocked with bowstring 66 at the time of firing. If a crossbow is fired without an arrow present, the forces generated by the crossbow can result in the bowstring and/or power cables breaking, or in the entire crossbow coming apart, posing a significant danger to the user and others nearby. Referring to FIGS. 13, 15, and 18A, ADF catch 164 is normally pulled upright by bias spring 172. As shown in FIG. 18A, bowstring 66 lies just ahead of ADF catch 164, while D-loop 67 is engaged by bowstring hook 162, behind ADF catch 164. Under normal firing conditions, arrow nock 194 (see FIG. 15) is engaged with bowstring 66, and the presence of arrow nock 194 forces ADF catch 164 downward to a more horizontal position (as per FIG. 16). If trigger 26 of lower receiver 22 is now pulled, and hammer 169 of lower receiver 22 strikes the lower end 181 of sear member 180, sear edges 183 and 163 disengage from each other, and bowstring hook 162 rotates downward. A forwardly projecting nub 165 formed upon bowstring hook 162 temporarily engages the upper end of ADF catch 164, as shown in FIG. 15, to retard the rise of ADF catch 164 until D-loop 67 is entirely free from bowstring hook 162, and until bowstring hook 162 rises back up.

On the other hand, if no arrow is properly nocked in crossbow 20 at the time of firing, then ADF catch 164 remains in its upright position shown in FIGS. 13 and 18A. If the crossbow is inadvertently fired with no arrow present, then bowstring hook 162 will rotate downward to release D-loop 67; however, D-loop 67 will be caught by ADF catch 164, and bowstring 66 will not be released. Remedial action may then be taken to avoid danger to the user, as by re-inserting inserting the crank arm and manually unwinding rope 88 from rope spool 120 while disengaging pawl 148.

Figure 18:
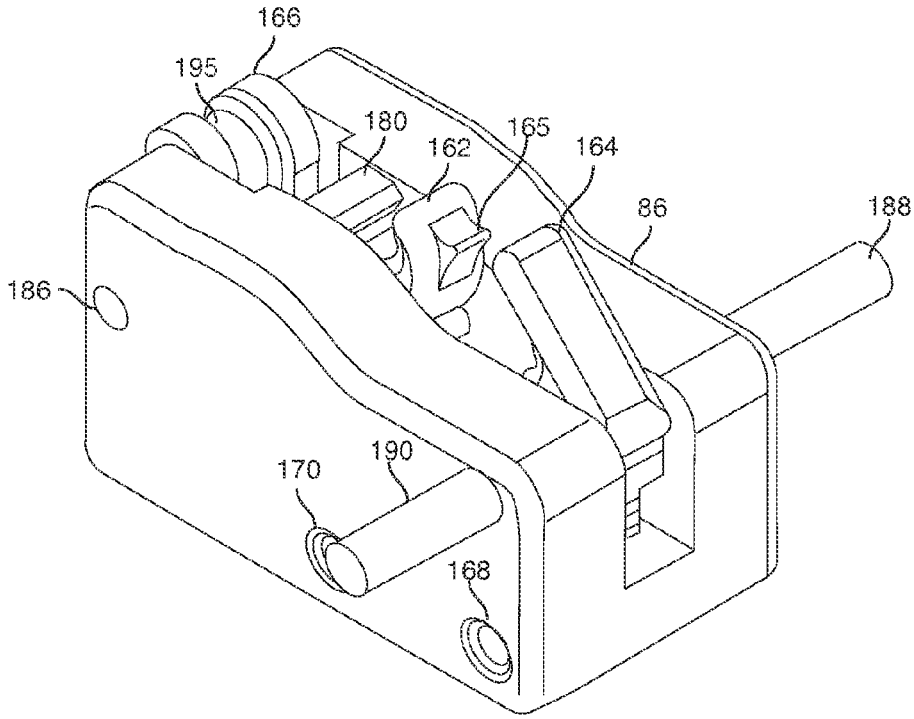
FIG. 18 is a perspective view of the bowstring release shown in FIG. 13.
Figure 18A:
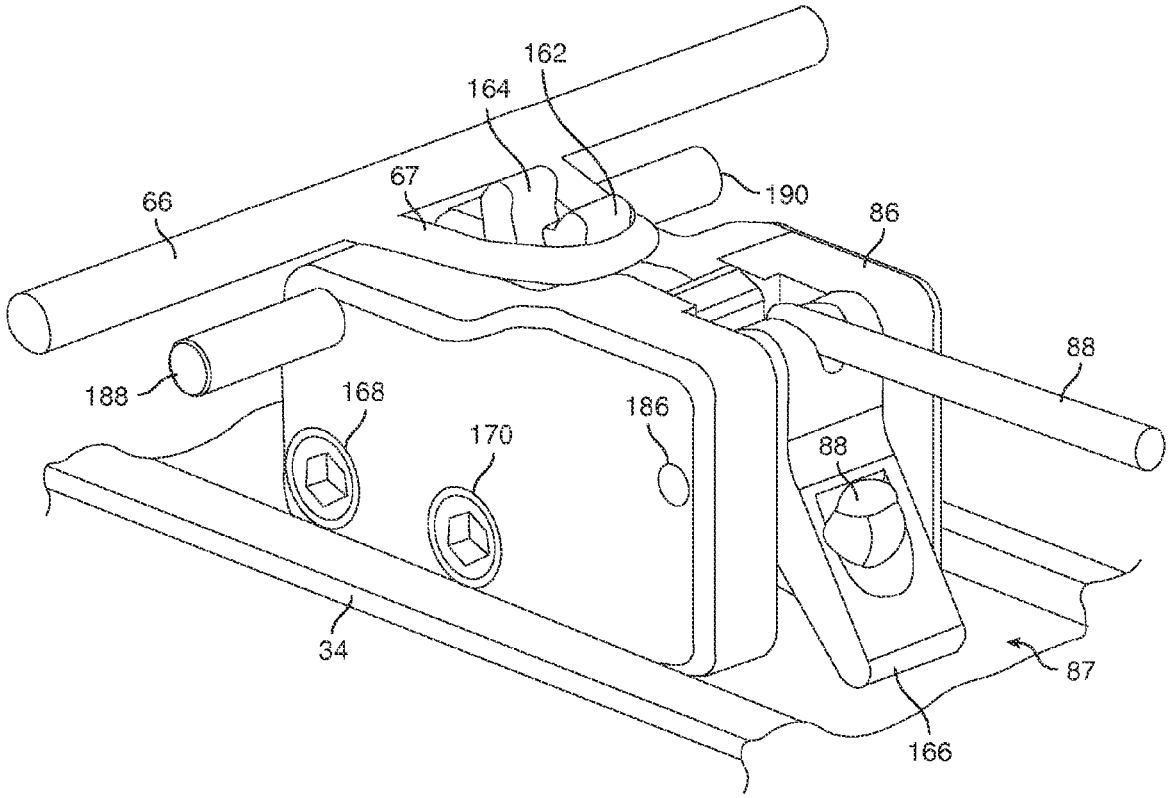
FIG. 18A is a partial perspective view of the bowstring release engaged with a D-loop attached to the bowstring in preparation for retracting the bowstring.

As shown best in FIG. 18, pins 188 and 190 extend from opposing sides of bowstring release 86. If desired, these pins 188 and 190 may actually be integral with pivot pin 174 about which ADF catch 164 pivots. Pins 188 and 190 aid in guiding bowstring release 86 into the proper fully-drawn position within upper housing 82. Pins 188 and 190 enter into cut-outs 100 and 102 (see FIGS. 4 and 5) of upper housing 82 when bowstring release 86 is fully drawn into upper housing 82 to help ensure that bowstring release 86 has been retracted into its fully drawn position.

Figure 17:
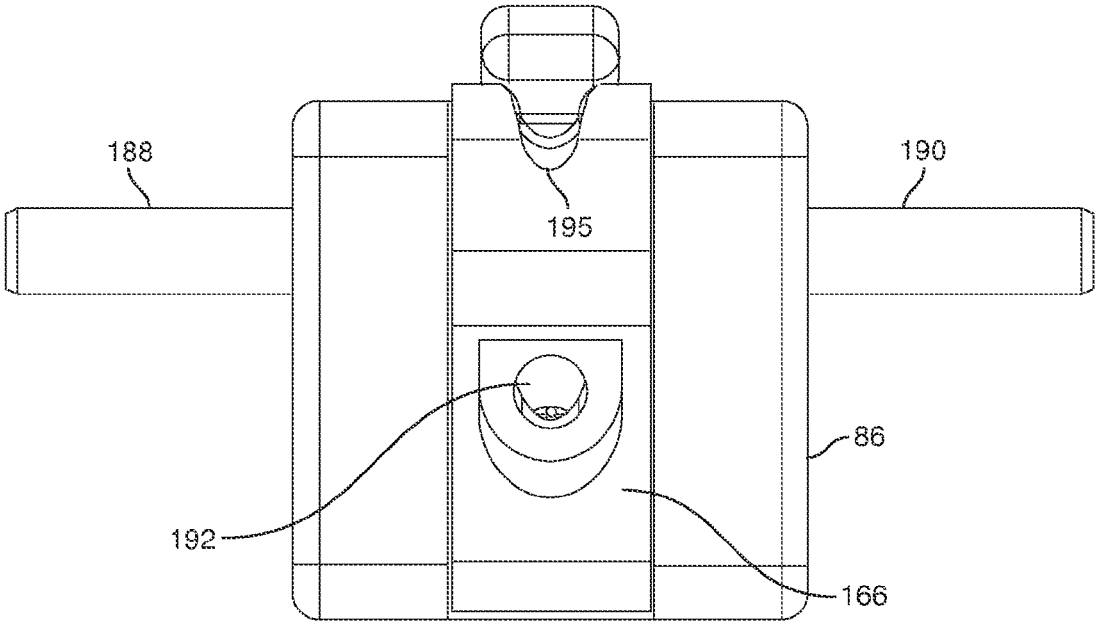
FIG. 17 is a rear view of the bowstring release shown in FIG. 13.

As mentioned earlier, hammer 169 of lower receiver 22 must be cocked before pulling trigger 26. For this reason, bowstring release 86 includes a cocking lever 166 protruding downwardly from the rear end of bowstring release 86. Referring briefly to FIGS. 17 and 18A, cocking lever 166 is designed to engage the free end of retractor rope 88. The free end of retractor rope 88 is passed over the upper end of cocking lever 166 and then through the lower end of cocking lever 166, terminating in an oversized knot 88'. Referring to FIGS. 17 and 18, the upper end of cocking lever 166 has a central channel 195 over which the free end of retractor rope 88 is passed. The free end of rope 88 is then passed down the front side of cocking lever 166 and back out through a hole 192 formed in the lower portion of cocking lever 166 before being formed into an enlarged knot 88'.

When bowstring release 86 is being retracted, rope 88 pulls the upper end of cocking lever 166 backward, forcing the lower end of cocking lever 166 into the configuration shown in FIGS. 13-16. As bowstring release 86 is retracted into upper housing 82, cocking lever 166 catches on the upper end of hammer 169 of lower receiver 22 and forces hammer 169 backward into its cocked position; cocking lever 166 ultimately passes beyond the upper end of hammer 169 as bowstring release 86 is fully retracted.

After the crossbow is fired, and the pawl release knob is operated to release rope spool 120, rope 88 becomes slack, and cocking lever 166 is free to pivot about pivot pin 186. As bowstring release 86 is withdrawn from upper housing 82, cocking lever 166 engages the upper end of hammer 169 of the lower receiver; upon such engagement, cocking lever 166 merely pivots in a counter-clockwise direction (relative to FIGS. 13-16) about pivot pin 186, whereby cocking lever is dragged over the hammer without interfering with the forward movement of bowstring release 86.

Crossbow 20 can be formed by coupling crossbow accessory 24 to modular lower receiver 22. The second end of frame member 34 is coupled to lower receiver 22, as by passing pins through attachment holes formed in second end 38 of frame member 34 which mate with attachment holes in the modular lower receiver. Bowstring 66 is retracted toward second end 38 of frame member 34 toward its drawn position, engaged with bowstring hook 162 of bowstring release 86.

The lower end 181 of sear member 180 of bowstring release 86 is positioned proximate to hammer 169 of lower receiver 22 for being contacted by the hammer to release bowstring 66 when trigger 26 of lower receiver 22 is operated. Bowstring hook 162 is engaged with a D-loop attached to bowstring 66 before retracting bowstring 66. Bowstring release 86 is then refracted toward second end 38 of frame member 34, thereby pulling bowstring 66 away from riser 40 toward its fully-drawn position proximate second end 38 of frame member 34. Bowstring release 86 is pulled into upper housing 82 proximate lower receiver 22, and the actuating lever (sear member 180) is positioned proximate to hammer 169 of lower receiver 22, whereby operation of trigger 26 of lower receiver 22, and resulting rotation of hammer 169, cause bowstring release 86 to release bowstring 66 therefrom.

Cocking lever 166 engages the upper end of hammer 169 of lower receiver 22, as bowstring release 86 is retracted, to cock the hammer. Preferably, cocking lever 166 is pivotally secured to bowstring release 86, and one end of retractor rope 88 is secured to cocking lever 166. When the rope 88 is taut (as when bowstring 66 is being retracted), cocking lever 166 is restrained against pivotal movement. Further retraction of bowstring 66 causes cocking lever 166 of bowstring release 86 to engage hammer 169, and to rotate the hammer to its cocked position. On the other hand, after bowstring 66 is released, and rope 88 is allowed to slacken, cocking lever 166 is allowed to pivot around hammer 169 of lower receiver 22 to permit bowstring release 86 to be withdrawn from upper housing 82.

Spool 120 is rotatably supported within upper housing 82. A first end of rope 88 is wound about spool 120, and the second, opposing end of rope 88 is coupled to bowstring release 86. A user rotates spool 120 to wind rope 88 around spool 120 to pull bowstring release 86, and bowstring 66, toward the drawn position. Winding the first end of rope 88 about spool 120 includes the forming a rope attachment hole 134 extending transversely through spool 120, and passing an end of rope 88 through rope attachment hole 134 for securing rope 88 to spool 120.

Gear 124 is coupled to spool 120, and a pawl is engaged with gear 124 for permitting rotation of spool 120 in a first direction, and for selectively preventing rotation of spool 120 in a second, opposing direction.

Gear 122 is coupled to spool 120, and drive axle 138 is rotatably mounted in upper housing 82. A spur gear 136 is provided on drive axle 138, and spur gear 136 is engaged with spool gear 122. Drive axle 138 is cranked to rotate spool 120 for winding rope 88 about spool 120 to retract bowstring release 86 and bowstring 66.

Use of the AR15 lower receiver trigger assembly allows crossbow 20 to fire an arrow with minimal finger pressure (i.e., trigger pull force) notwithstanding significant tension (170 pounds or more) on the bowstring. In this regard, the trigger pull force is entirely independent of the tension on the bowstring. It is only necessary that hammer 169 of the lower receiver apply sufficient force to sear member 180 to activate bowstring release 86. In addition, as explained above, cocking lever 166 on bowstring release 86 automatically cocks hammer 169 of lower receiver 22 as bowstring 66 is retracted.

When purchasing the lower receiver of the AR-15 modular rifle within the United States from one of the many manufacturers of such rifles, a purchaser must obtain a federal gun license. Those sportsman who already own an AR-15 rifle do not require an additional federal license to equip the lower receiver of their rifle with the crossbow accessory of the present invention. In addition, manufacturers of AR-15 rifles, or other weapons that include the lower receiver of an AR-15 rifle, must currently pay an 11% federal excise tax, based upon the wholesale price of the weapon, when such rifles are originally sold to distributors or retailers. On the other hand, the crossbow accessory of the present invention can be sold without payment of the current federal excise tax, as it is can be sold without the lower receiver of the AR-15 rifle to end users who already own a lower receiver of the AR-15 rifle.

The use of bowstring release 86 and flexible retractor rope 88, along with the pawl release and innovative cocking lever, allows a user to fire an arrow, retract the bowstring, and prepare to fire a second arrow, much more quickly than other crossbows. Moreover, the precise positioning of the bowstring release within the upper housing allows highly accurate shots to be consecutively fired, arrow after arrow.

Figure 19:
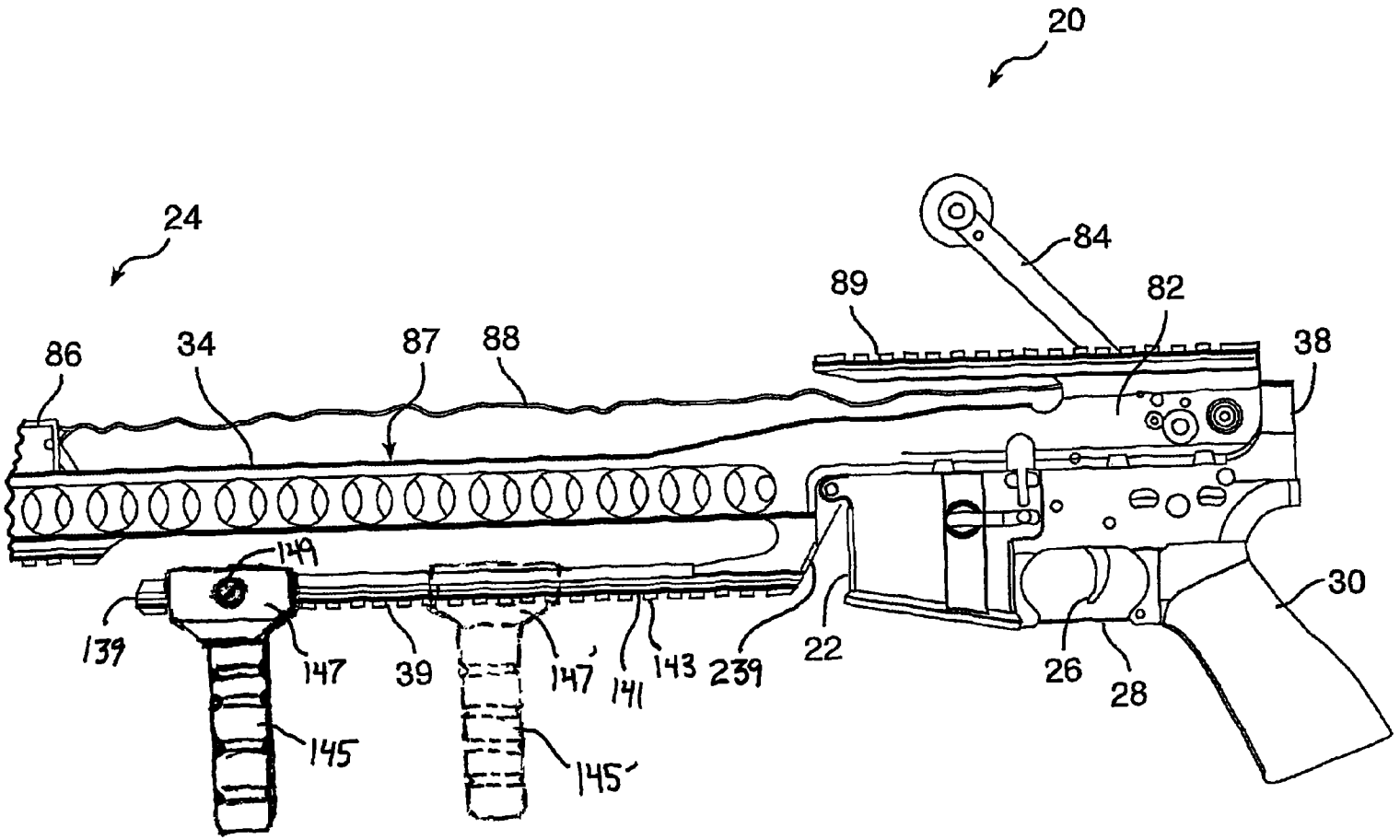
FIG. 19 is a partial side view of the crossbow, similar to FIG. 3, but illustrating the attachment of a fore-grip to the floating support rail extending below the elongated frame member.

Referring now to FIG. 19, crossbow assembly 24 includes lower floating support rail 39 which includes a front end 139 and an opposing rear end 239. Support rail 39 extends along and below elongated frame member 34; rear end 239 of support rail 39 is secured generally proximate to rear end 38 of elongated frame member 34. As shown in FIG. 19, rear end 239 preferably joins with elongated frame member 34 just ahead of lower receiver 22, and relatively near, but ahead of, trigger 26. Front end 139 of support rail 39 extends forwardly generally toward front end 36 (see FIG. 3) of elongated frame member 34, and is spaced apart therefrom. Support rail 39 is adapted to assist a user in supporting the crossbow in a steady manner during release of the bowstring. Support rail 39 is preferably made of aluminum. In the preferred embodiment, support rail 39 is actually integral with elongated frame member 34.

Support rail 39 is preferably formed as a so-called "Picatinny" rail", or a MIL-STD-1913 rail, and has a generally inverted T-shaped cross-section. Viewing support rail 39 from the bottom, support rail 39 includes a series of ridges 141 interspersed with flat spacing slots 143. Such rails are commonly known in the firearms industry for supporting such accessories as telescopic sights, tactical lights, night vision devices, laser sighting modules, reflex sights, fore-grips, bi-pods, and bayonets. Support rail 39 is adapted to slidingly receive accessories, which may include a support member to help steady crossbow 24 during firing. As shown in FIG. 19, one such support member is a vertical fore-grip 145 which includes an upper clamp member 147 that is slidingly received by support rail 39. Upper clamp member 147 includes a clamp screw 149 for selectively clamping fore-grip 145 at a desired location along support rail 39. Fore-grip 145 can be grasped by a user's left hand, while the user grasps first grip 30 with the user's trigger hand. As indicated in FIG. 19, fore-grip 145 can be shifted to a second position indicated by dashed lines 145'/147' to accommodate a user of smaller size.

As mentioned above, users tend to grab the forward stock of a crossbow at different points, depending upon their size and build. With respect to FIG. 19, a user might grasp support rail 39 at one point (e.g., the point at which fore-grip 145 is shown in solid lines), but grasp support rail 39 at a different point (e.g., the point at which fore-grip 145' is shown) on the next shot. This minor variation in grasping the crossbow could introduce inconsistencies in the firing of successive arrows, were it not for the fact that floating support rail 39 is only secured to elongated frame member 34 at rear end 239 of support rail 39, and nowhere else.

Likewise, if a user were to decide to move fore-grip 145 from its initial position shown in solid lines in FIG. 19 to an alternate position closer to trigger 26, e.g., to the dashed line position 145' shown in FIG. 19, the firing characteristics of crossbow 24 will not change dramatically or noticeably because floating rail 39 is still secured to elongated frame member 34 only at rear end 239. The same would be true if, for example, a user rested support rail 39 on a sandbag near front end 139 during a first shot, but rested support rail 39 on the sandbag at a point located closer to the trigger on the next succeeding shot. Arrow placement will remain more consistent no matter what portion of support rail 39 is engaged by the sandbag, bi-pod, fore-grip, or hand.

Those skilled in the art will now appreciate that the present invention provides a crossbow adapted to be grasped by both hands of a user during firing, while minimizing any variation in arrow flight that might otherwise result from the user's change of fore-end grip from one shot to the next. The floating support rail achieves relatively consistent arrow placement for users of varying body builds and arm spans. Moreover, the floating support rail can be rested upon a bi-pod, sandbag, or the like during firing, while minimizing any variation in arrow flight, from one shot to the next, that might otherwise result from shifting the point at which the crossbow contacts the bi-pod, sandbag, or other stabilizing support.

While the present invention has been described with respect to a preferred embodiment thereof, such description is for illustrative purposes only, and is not to be construed as limiting the scope of the invention. For example, while the preferred embodiment described above forms the crossbow assembly by coupling a crossbow accessory with a lower receiver of an AR-15 rifle, those skilled in the art will understand and appreciate that the floating support rail may likewise be used with more conventional crossbows that incorporate an integral trigger mechanism. Similarly, although the crossbow described above in conjunction with the patent drawing figures is a "rail-less" type crossbow (i.e., the arrow, or "bolt", does not slide across a "rail" as the arrow is fired), one may, of course, use the support rail of the present invention with a crossbow of the type that is adapted to project the arrow, or "bolt", along a "rail". Various other modifications and changes may be made to the described embodiments by those skilled in the art without departing from the true spirit and scope of the invention as defined by the appended claims.

We claim:

1. A crossbow comprising in combination:

a. a riser having a central portion and opposing end portions;

b. first and second limbs coupled to the opposing end portions of the riser, the first limb extending from the riser toward a first limb tip, and the second limb extending from the riser toward a second limb tip;

c. a bowstring extending between the first limb tip and the second limb tip for propelling an arrow;

d. an elongated frame member having front and rear opposing ends, the front end being coupled to the riser, e. a bowstring release coupled to the rear end of the elongated frame member, the bowstring release having a trigger mechanism adapted to be operated by a finger on a user's first hand, the bowstring release being responsive to the trigger mechanism for selectively releasing the bowstring when a user operates the trigger mechanism;

f. a first grip disposed proximate to the trigger mechanism and being adapted to be grasped by the user's first hand; and g. a rail having opposing front and rear ends thereof, the rail extending along and below the elongated frame member, the rear end of the rail being secured generally proximate to the rear end of the elongated frame member, the front end of the rail extending forwardly generally toward the front end of the elongated frame member and spaced apart therefrom, the rail avoiding physical coupling with the riser except proximate to the rear end of the rail, the rail being adapted to assist the user in supporting the crossbow during release of the bowstring.

2. The crossbow recited by claim 1 wherein the rail is integral with said elongated frame member.

3. The crossbow recited by claim 1 wherein the rail is adapted to receive a support member.

4. The crossbow recited by claim 3 wherein the support member is a second grip.

5. The crossbow recited by claim 4 wherein the second grip is slidingly received by the rail.

6. The crossbow recited by claim 1 wherein the rail has a generally T-shaped cross-section and includes a series of ridges interspersed with flat spacing slots.

7. A crossbow comprising in combination:

a. a riser having a central portion and opposing end portions;

b. first and second limbs coupled to the opposing end portions of the riser, the first limb extending from the riser toward a first limb tip, and the second limb extending from the riser toward a second limb tip;

c. a bowstring extending between the first limb tip and the second limb tip for propelling an arrow;

d. an elongated frame member having front and rear opposing ends, the front end being coupled to the riser, e. a bowstring release coupled to the rear end of the elongated frame member, the bowstring release having a trigger mechanism adapted to be operated by a finger on a user's first hand, the bowstring release being responsive to the trigger mechanism for selectively releasing the bowstring when a user operates the trigger mechanism;

f. a first grip disposed proximate to the trigger mechanism and being adapted to be grasped by the user's first hand; and g. a rail having opposing front and rear ends thereof, the rail extending along and below the elongated frame member, the rear end of the rail being secured generally proximate to the rear end of the elongated frame member, the front end of the rail extending forwardly generally toward the front end of the elongated frame member and spaced apart therefrom, the rail avoiding physical coupling with the elongated frame member except proximate to the rear end of the rail, the rail being adapted to assist the user in supporting the crossbow during release of the bowstring.

8. The crossbow recited by claim 7 wherein the rail is integral with said elongated frame member.

9. The crossbow recited by claim 7 wherein the rail is adapted to receive a support member.

10. The crossbow recited by claim 9 wherein the support member is a second grip.

11. The crossbow recited by claim 10 wherein the second grip is slidingly received by the rail.

12. The crossbow recited by claim 7 wherein the rail has a generally T-shaped cross-section and includes a series of ridges interspersed with flat spacing slots.

13. A crossbow comprising in combination:

a. a riser having a central portion and opposing end portions;

b. first and second limbs coupled to the opposing end portions of the riser, the first limb extending from the riser toward a first limb tip, and the second limb extending from the riser toward a second limb tip;

c. a bowstring extending between the first limb tip and the second limb tip for propelling an arrow;

d. an elongated frame member having front and rear opposing ends, the front end being coupled to the riser, e. a bowstring release coupled to the rear end of the elongated frame member, the bowstring release having a trigger mechanism adapted to be operated by a finger on a user's first hand, the bowstring release being responsive to the trigger mechanism for selectively releasing the bowstring when a user operates the trigger mechanism;

f. a first grip disposed proximate to the trigger mechanism and being adapted to be grasped by the user's first hand; and g. a rail having opposing front and rear ends thereof, the rail extending along and below the elongated frame member, the rear end of the rail being secured generally proximate to the rear end of the elongated frame member, the front end of the rail extending forwardly generally toward the front end of the elongated frame member and spaced apart therefrom, the front end of the rail terminating before reaching the riser, the rail being adapted to assist the user in supporting the crossbow during release of the bowstring.

14. The crossbow recited by claim 13 wherein the rail is integral with said elongated frame member.

15. The crossbow recited by claim 13 wherein the rail is adapted to receive a support member.

16. The crossbow recited by claim 15 wherein the support member is a second grip.

17. The crossbow recited by claim 16 wherein the second grip is slidingly received by the rail.

18. The crossbow recited by claim 13 wherein the rail has a generally T-shaped cross-section and includes a series of ridges interspersed with flat spacing slots.

* * * * *